US006671155B2

(12) United States Patent
Bennett et al.

(10) Patent No.: US 6,671,155 B2
(45) Date of Patent: Dec. 30, 2003

(54) SURGE PROTECTOR WITH THERMALLY ACTIVATED FAILSAFE MECHANISM

(75) Inventors: Robert J. Bennett, Lewisville, TX (US); Gustavo A. Gonzalez, Jr., N. Richland Hills, TX (US); Casimir Z. Cwirzen, Colleyville, TX (US)

(73) Assignee: Corning Cable Systems LLC, Hickory, NC (US)

( * ) Notice: Subject to any disclaimer, the term of this patent is extended or adjusted under 35 U.S.C. 154(b) by 209 days.

(21) Appl. No.: 09/998,369

(22) Filed: Nov. 30, 2001

(65) Prior Publication Data

US 2003/0103308 A1 Jun. 5, 2003

(51) Int. Cl.[7] ..... H01C 7/12
(52) U.S. Cl. ..... 361/118; 337/29; 379/412
(58) Field of Search ..... 361/118, 117; 337/29; 379/412

(56) References Cited

U.S. PATENT DOCUMENTS

| | | | | | |
|---|---|---|---|---|---|
| 3,254,179 | A | | 5/1966 | Howard | 200/115 |
| 3,281,625 | A | | 10/1966 | Wanaselja | 317/9 |
| 3,522,570 | A | | 8/1970 | Wanaselja | 337/28 |
| 3,573,695 | A | * | 4/1971 | Geyer et al. | 337/29 |
| 3,936,785 | A | | 2/1976 | Novak | 337/29 |
| 4,009,422 | A | | 2/1977 | Woodfill | 361/120 |
| 4,062,054 | A | | 12/1977 | Simokat | 361/119 |
| 4,132,915 | A | | 1/1979 | Wilms | 313/325 |
| 4,133,019 | A | | 1/1979 | Roach et al. | 361/124 |
| 4,212,047 | A | | 7/1980 | Napiorkowski | 361/124 |
| 4,340,923 | A | | 7/1982 | Bazarian et al. | 361/120 |
| 4,583,954 | A | * | 4/1986 | Chapman et al. | 445/7 |
| 4,603,368 | A | | 7/1986 | Pagliuca | 361/119 |
| 4,944,003 | A | | 7/1990 | Meyerhoefer et al. | 379/412 |
| 5,166,855 | A | | 11/1992 | Turner | 361/119 |
| 5,187,634 | A | | 2/1993 | Pitsch et al. | 361/119 |
| 5,500,782 | A | | 3/1996 | Oertel et al. | 361/120 |
| 5,561,582 | A | | 10/1996 | Geishecker et al. | 361/118 |
| 5,909,351 | A | | 6/1999 | Kane | 361/120 |

* cited by examiner

*Primary Examiner*—George J. Toatley, Jr.
*Assistant Examiner*—James A Demakis
(74) *Attorney, Agent, or Firm*—Michael E. Carroll, Jr.

(57) ABSTRACT

A surge protector having a failsafe mechanism including at least one overvoltage protection element, at least one arm assembly, at least one ground element, at least one resilient member, and at least one protrusion. The at least one resilient member is electrically connected to the at least one ground element and the at least one protrusion is generally positioned between the at least one resilient member and the at least one arm assembly. The at least one protrusion is in thermal contact with the at least one resilient member, prevents the at least one resilient member from electrically contacting the at least one arm assembly during normal operation, and is spaced away from the at least one arm assembly. As a result of a sustained overvoltage condition, the temperature of the at least one resilient member increases thereby softening the at least one protrusion and allowing the at least one resilient member to electrically contact the at least one arm assembly to short the at least one arm assembly to the ground element.

28 Claims, 8 Drawing Sheets

10
48
40
36
16c
70
52b
48
16
26b
52
50
16a
52a
26a
16b
40
13
40a
13c
13b
60
12
13a
14c
60b
14
14a
24b
14b
34
8
24a

SURGE PROTECTOR WITH THERMALLY ACTIVATED FAILSAFE MECHANISM

FIELD OF THE INVENTION

The present invention relates generally to surge protectors, and more particularly, to a surge protector provided with a thermally activated failsafe mechanism for use with, for example, telephone equipment.

BACKGROUND OF THE INVENTION

Surge protectors are widely used for the protection of equipment from overvoltage conditions that may be caused, for example, by lighting or high voltage line contact. For example, telecommunication lines employ various types of surge protectors, which at a minimum, provide overvoltage protection. This is typically done with at least one protection element that is inserted between a conductive tip element of a surge protector and ground. Likewise, typically at least one protection element is inserted between a conductive ring element of the surge protector and ground. When a hazardous overvoltage is present on a line, the overvoltage protection element, for example a gas tube, changes from a high impedance to a low impedance state. This change of impedance effectively shorts the hazardous overvoltage and its associated overcurrent to ground and away from equipment and/or personnel.

A sustained overvoltage is an overvoltage event that which causes excessive heat when the overvoltage, along with the associated overcurrent, flows through the surge protector and is shorted to ground. For example, a sustained overvoltage can occur where a power line has come in continued contact with a protected telephone line, thereby producing a continuous ionization of the gas tube and the resultant passage of overcurrent through the gas tube to ground. Such overcurrent will in many cases destroy equipment and/or the surge protector.

A failsafe mechanism will remain unaffected when subjected to short and/or less severe overvoltage conditions that the surge protector is intended to handle; however, the failsafe mechanism is intended to permanently short this sustained overvoltage to ground.

One known method of providing a failsafe mechanism in a surge protector is the use of a metal fusible element such as a solder joint. The metal fusible element is designed to melt at a predetermined temperature and short the sustained overvoltage to ground. The use of a metal fusible element as a failsafe mechanism is reliable; however, the metal fusible element method requires multiple components, which makes the metal fusible element relatively expensive.

Another known method of providing a failsafe mechanism is the plastic compressive displacement method. This method requires an electrically conductive spring and a plastic member. The plastic member physically and directly contacts both a portion of a ring side, and/or a portion of a tip side and a ground element of a surge protector to insulate the electrical contact path therebetween. For example, the spring is electrically connected with the tip side and biased towards the plastic member, but cannot make electrical contact to short the tip side to the ground element because the plastic member prevents electrical contact. In other words, the plastic member displaces the spring while physically and directly contacting both the electrical contact point of the spring and the electrical contact point of the ground element. The electrical contact point of the spring is intended to come into electrical contact with the electrical contact point of the ground element if the failsafe mechanism is activated. In operation, as the temperature of the ground element of the surge protector increases due to a sustained overvoltage the plastic member melts allowing the spring to push its way through the plastic member to electrically contact and short the tip side and/or ring side to the ground element. Although, the plastic compressive displacement method is relatively inexpensive, the method is inherently unreliable. The plastic compressive displacement method is inherently unreliable because residual plastic from the melted plastic member can remain between the spring and the intended electrical contact point during the sustained overvoltage condition, thereby interfering with the path to ground. Consequently, telephone equipment and/or personnel can be exposed to hazardous voltages and/or currents because the spring did not properly short to ground.

SUMMARY OF THE INVENTION

The present invention is directed towards a surge protector having a failsafe mechanism including at least one overvoltage protection element, at least one arm assembly, at least one ground element, at least one resilient member, wherein the at least one resilient member is electrically connected to the at least one ground element, at least one protrusion operably positioned between the at least one resilient member and the at least one arm assembly, wherein the at least one protrusion is in thermal contact with the at least one resilient member, the at least one protrusion prevents the at least one resilient member from electrically contacting the at least one arm assembly during normal operation, and wherein as a result of a sustained overvoltage condition the temperature of the at least one resilient member increases to soften the at least one protrusion and allow the at least one resilient member to electrically contact the at least one arm assembly and thereby short the at least one arm assembly to the ground element.

The present invention is further directed to a surge protector having a failsafe mechanism including a base, at least one overvoltage protection element, at least one ground element, at least one arm assembly, at least one resilient member, wherein the at least one resilient member is electrically connected to the at least one ground element, at least one protrusion extending from the base, wherein the at least one protrusion is in thermal contact with the at least one resilient member and prevents the at least one resilient member from electrically contacting the at least one arm assembly during normal operation, and wherein as a result of a sustained overvoltage condition the temperature of the at least one resilient member increases thereby softening the at least one protrusion and allowing the at least one resilient member to electrically contact the arm assembly to short the arm assembly to ground.

The present invention is further directed to a surge protector having a failsafe mechanism including a base, the base having a generally planar surface, at least one overvoltage protection element, a ground element, the ground element comprising a ground pin, the ground pin having a collar, at least one arm assembly, a torsional spring, the torsional spring having at least one arm and a coil with an aperture therethrough, wherein the torsional spring is in electrical contact with the ground pin, and the coil of the torsional spring is disposed between the collar of the ground pin and the planar surface of the base, at least one protrusion extending from the planar surface of the base, wherein the at least one protrusion is in thermal contact with the at least one torsional spring and prevents the at least one torsional spring from electrically contacting the at least one arm assembly during normal operation, and wherein as a result of a sustained overvoltage condition the temperature of the at least one arm of the torsional spring increases thereby softening the at least one protrusion and allowing the at least one arm of the torsional spring to electrically contact the arm assembly to short the arm assembly to the ground pin.

BRIEF DESCRIPTION OF THE FIGS.

Figure 7:
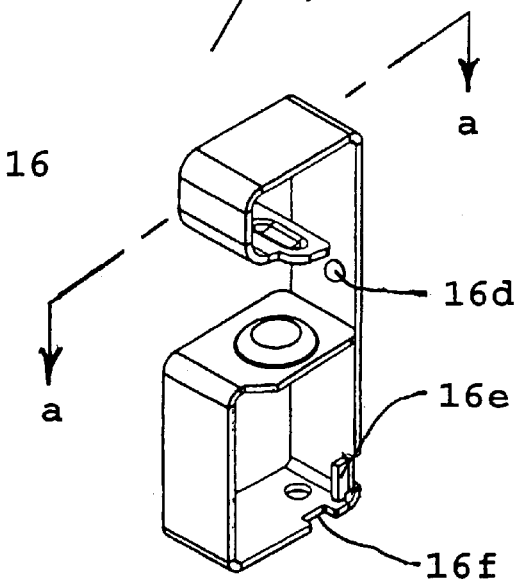
FIG. 7 is a perspective view of the ring arm of the surge protector of FIG. 1.
Figure 7A:
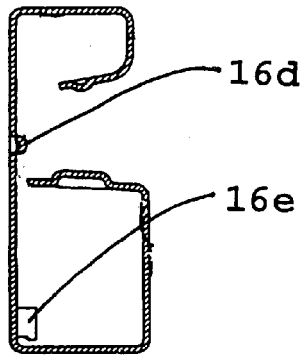

FIG. 7*a* is a sectional view of the ring arm of FIG. 7 taken through line a—a.

Figure 8:
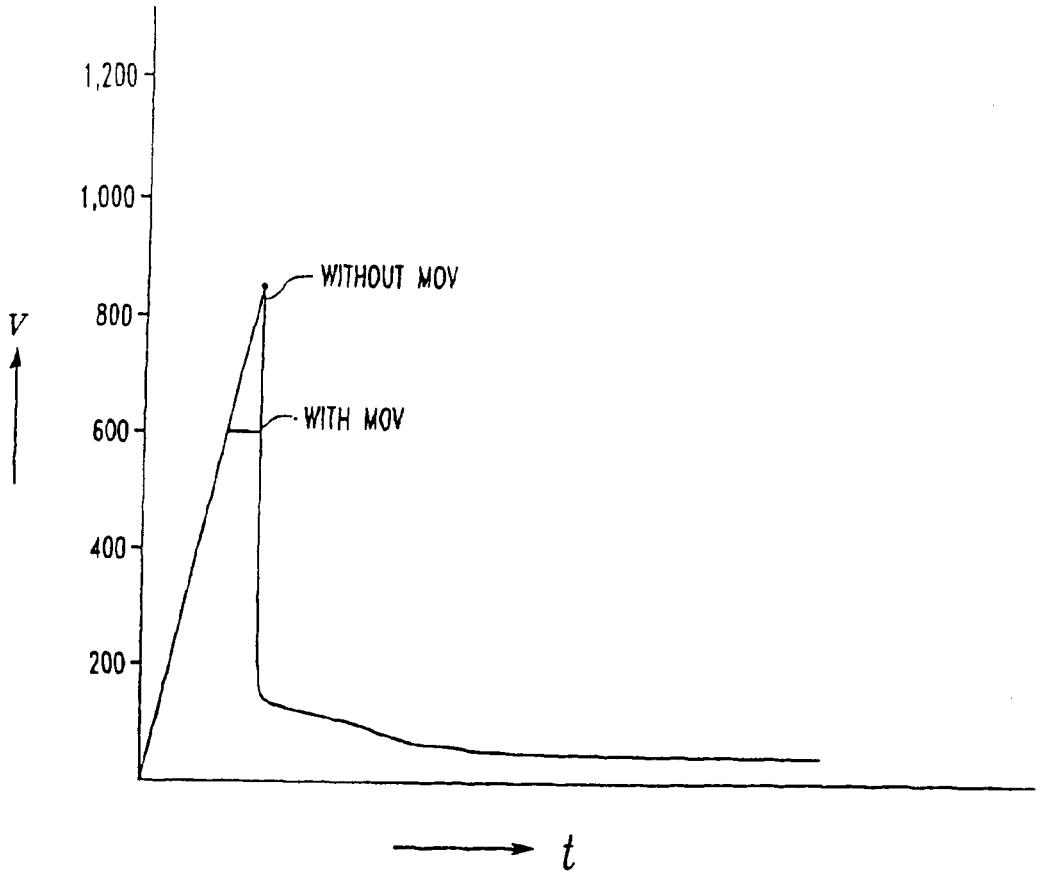

FIG. 8 is an exemplary graph illustrating the interaction of a varistor and a gas tube in responding to a voltage surge over time.

Figure 9:
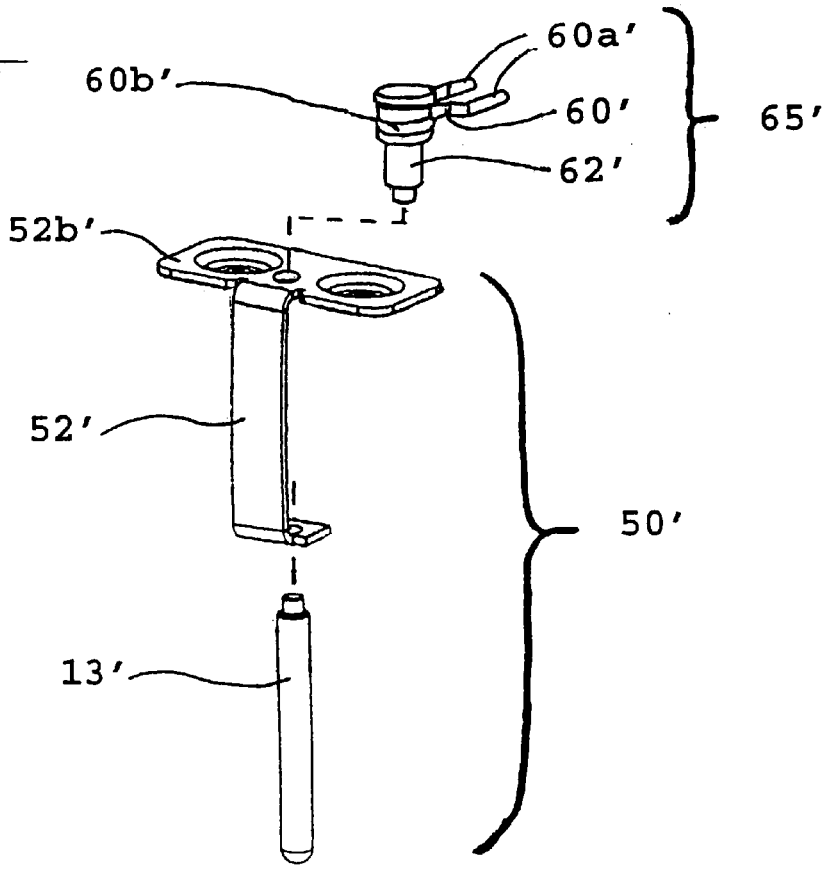

FIG. 9 is a perspective view of the ground element and the resilient member assembly according to another embodiment of the present invention.

Figure 10:
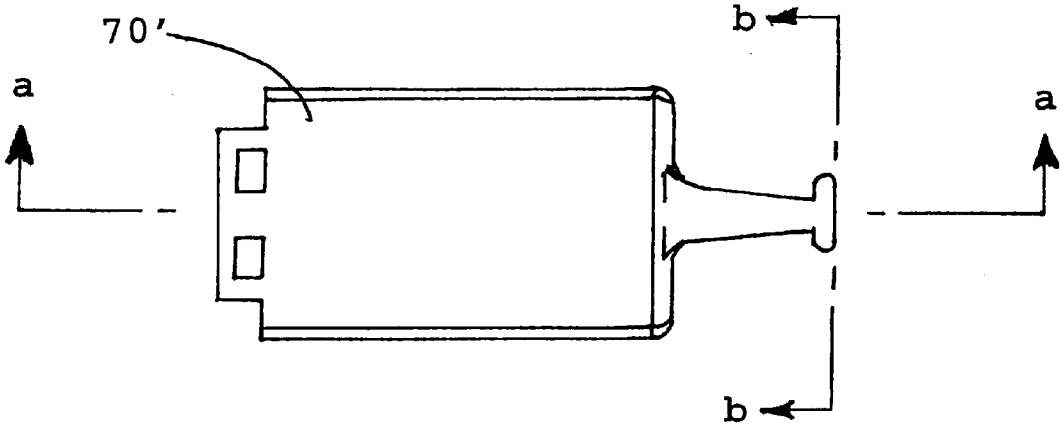

FIG. 10 is a plan view of a cover according to another embodiment of the present invention.

Figure 10A:
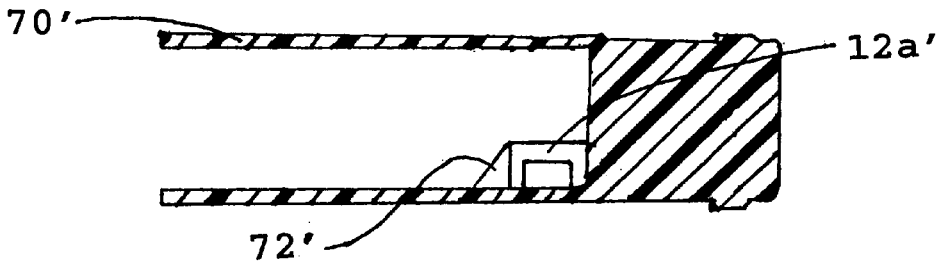

FIG. 10*a* is a sectional view of the cover of FIG. 10 taken through line a—a.

Figure 10B:
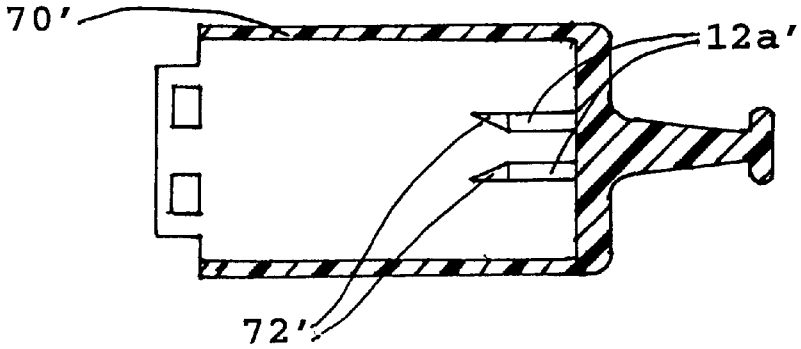

FIG. 10*b* is a sectional view of the cover of FIG. 10 taken through line b—b.

Figure 11:
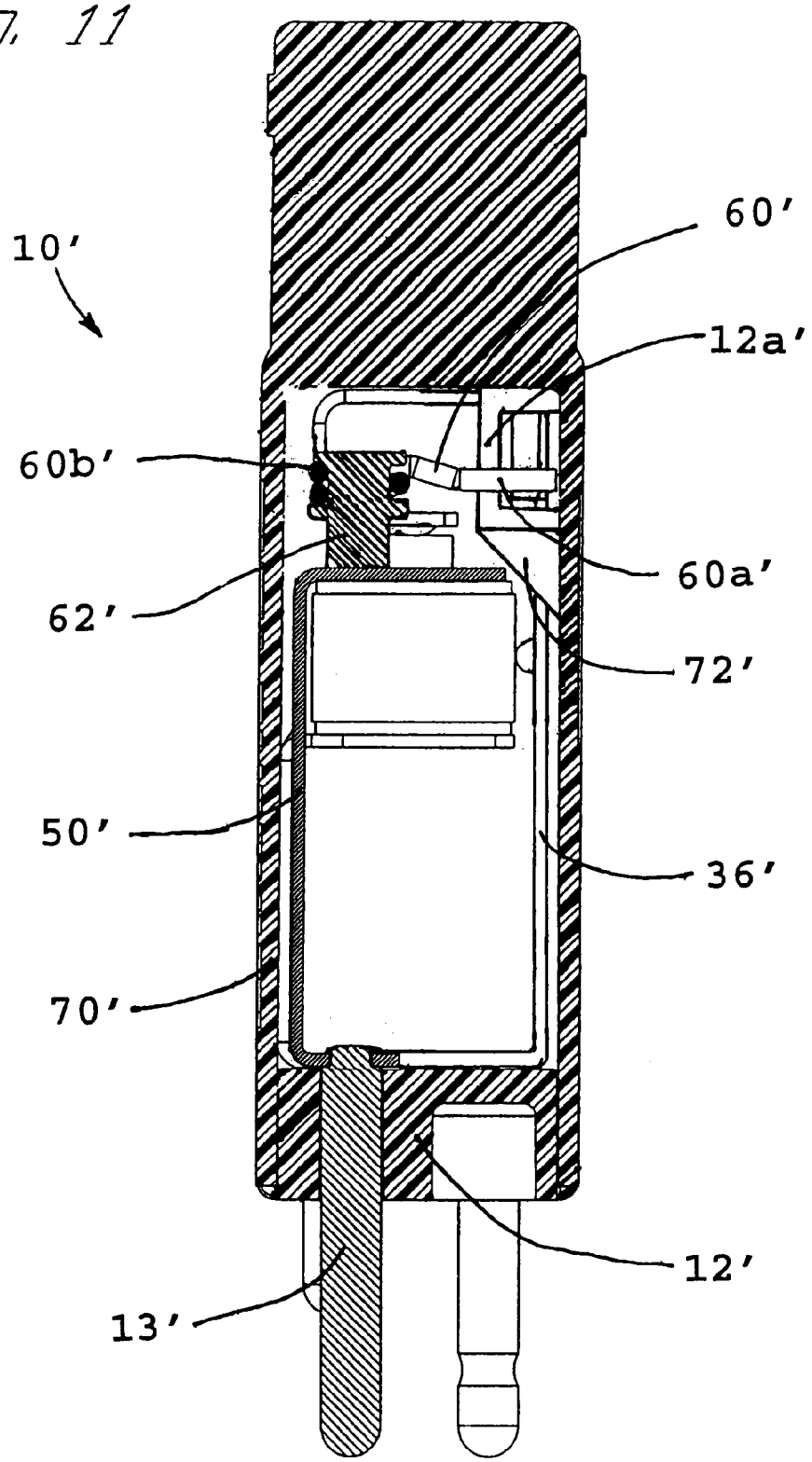

FIG. 11 is a sectional view of a surge protector of another embodiment as assembled and taken through the ground element.

DETAILED DESCRIPTION OF THE INVENTION

Figure 1:
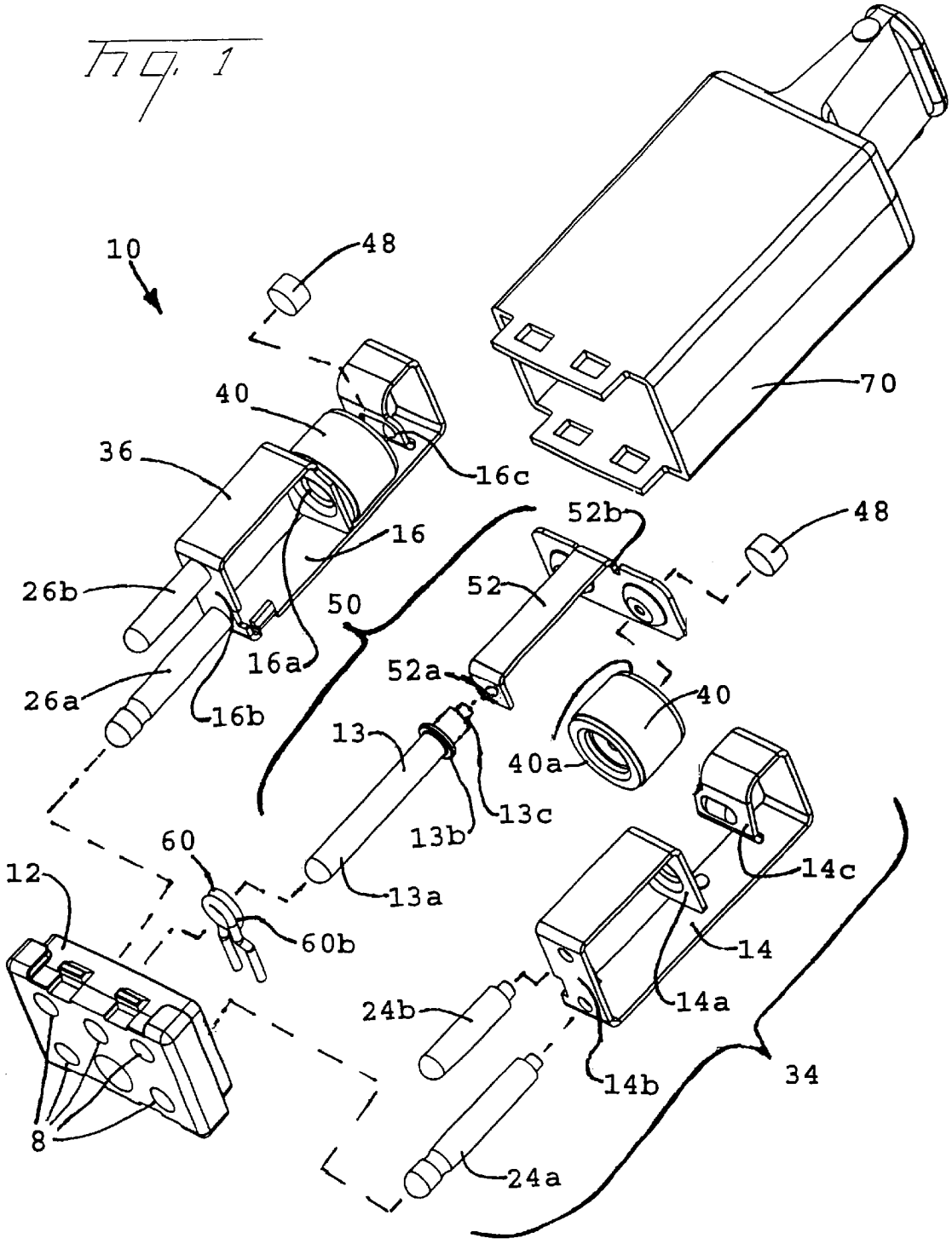
FIG. 1 is an exploded perspective view of a surge protector of one embodiment according to the present invention.
Figure 2:
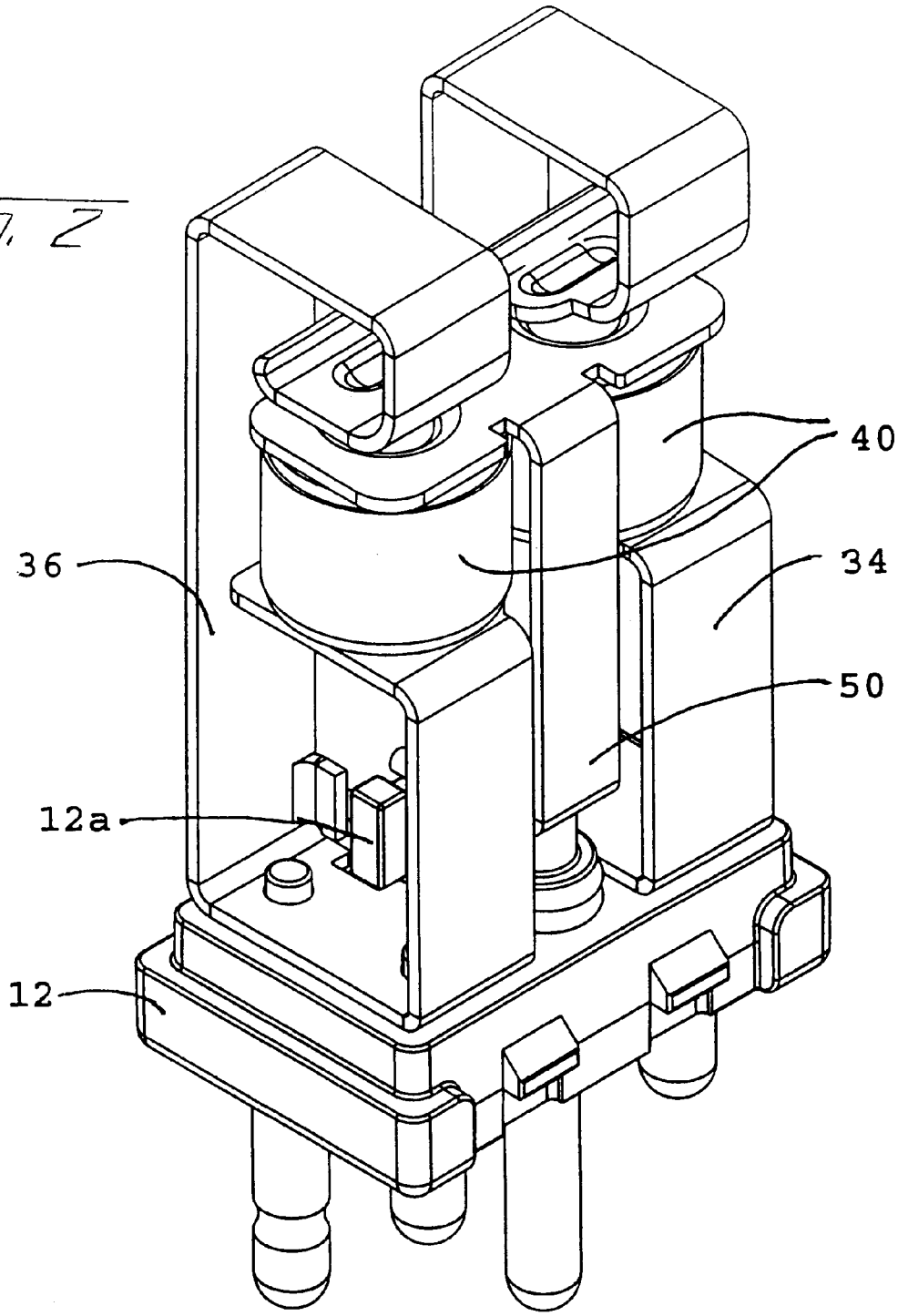
FIG. 2 is a perspective view of the surge protector of FIG. 1 as assembled shown with the cover removed.
Figure 3:
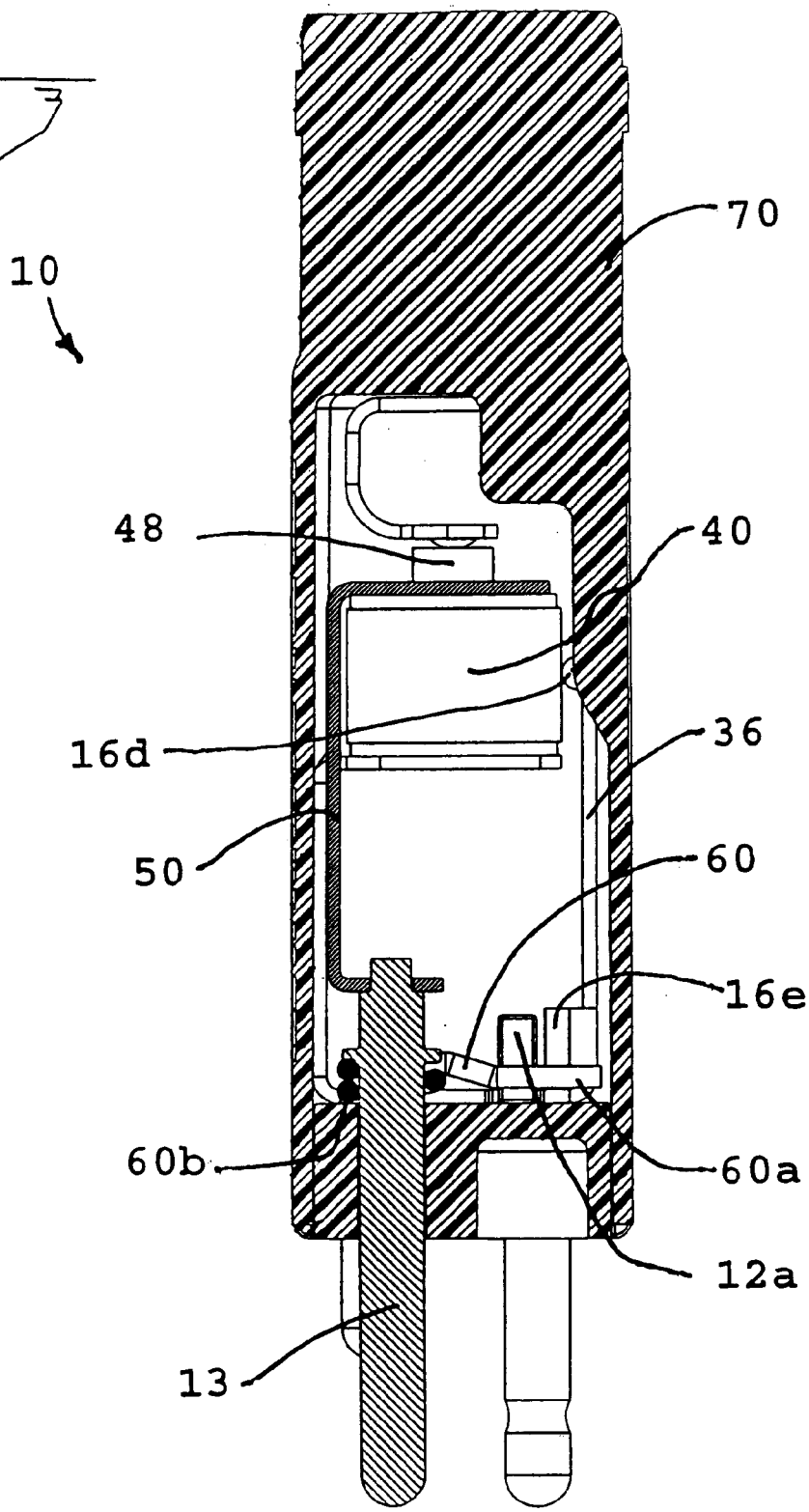
FIG. 3 is a sectional view of the surge protector of FIG. 1 as assembled and taken through the ground element.

Illustrated in FIGS. 1–3 is a surge protector 10 having a failsafe mechanism according to the present invention. Surge protector 10 is commonly referred to as a central office protector and is typically inserted into a connector block at a telephone central office to protect central office personnel and equipment from being damaged by surges caused, for example, by lightening or power crosses. However, the concepts of the present invention are applicable to other devices that employ failsafe mechanisms.

In one embodiment, surge protector 10 includes a dielectric base 12, tip arm assembly 34, a ring arm assembly 36, a pair of gas tubes 40, a pair of varistors 48, a ground element 50, a resilient member 60, and a cover 70. However, the concepts of the present invention may be used with other types of surge protectors such as station surge protectors, surge protectors having additional components such as sneak current protection components and/or fewer component(s), for example, no varistors. Additionally, instead of using gas tubes 40 and varistors 48 as an overvoltage protection element, other suitable overvoltage protection elements may be used, for example, only gas tubes, gas tubes having an air backup, gas tubes with interacting varistors and/or solid state devices.

Figure 4:
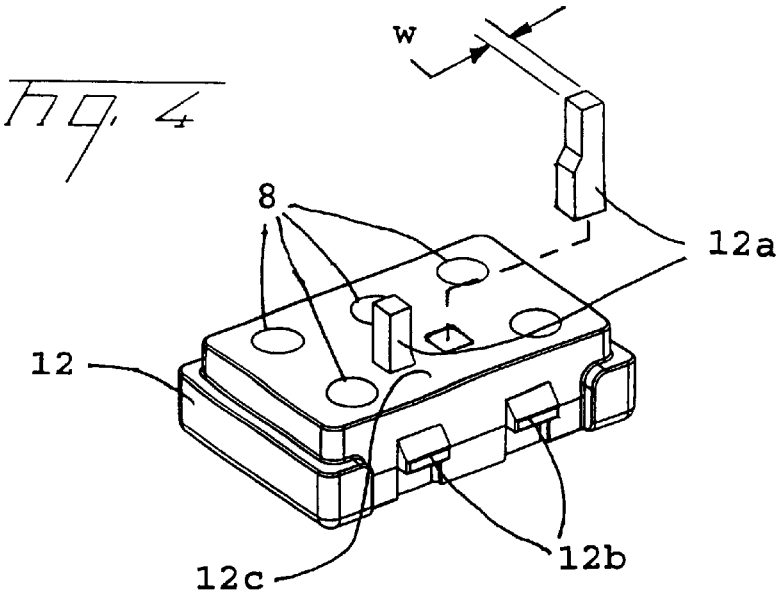
FIG. 4 is a perspective view of the base of FIG. 1.
Figure 5:
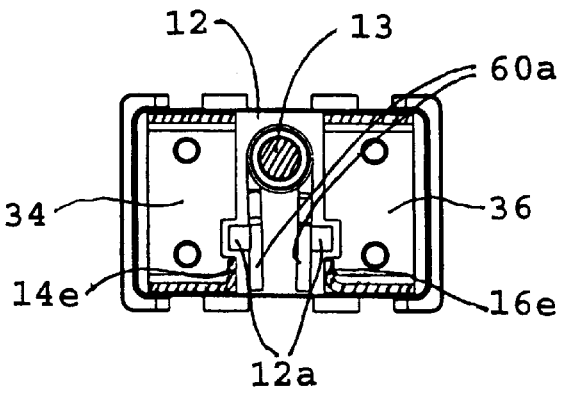
FIG. 5 is a sectional view of the surge protector of FIG. 1 with the cover removed taken through a transverse plane depicting the failsafe mechanism in an open circuit condition.

As shown in FIGS. 4 and 5, base 12 includes a pair of protrusions 12*a* for preventing resilient member 60 from shorting tip arm assembly 34 and/or ring arm assembly 36 to ground element 50 during normal operation. Protrusions 12*a* disposed on base 12 are operable to soften and/or melt as a result of a sustained overvoltage condition that increases the temperature of ground element 50 and resilient member 60. As a result of a sustained overvoltage condition, the contact pressure of the compressed resilient member 60 against protrusions 12*a* causes resilient member 60 to displace, by deflecting and/or slicing a portion thereof, the softened and/or melted protrusions 12*a*. When protrusions 12*a* are so displaced by resilient member 60, arm assemblies 34 and/or 36 short to ground element 50, through resilient member 60, without protrusions 12*a* interfering with the electrical path between resilient member 60 and arm assemblies 34 and/or 36. In other words, in one embodiment of the present invention protrusions 12*a* are advantageously spaced apart from a portion of arm assemblies 34 and/or 36 that are aligned to electrically contact resilient member 60 (See FIGS. 3 and 5). As used herein, spaced apart means protrusions 12*a* may contact arm assemblies 34 and/or 36; however, protrusions 12*a* are disposed so they are not located physically and directly between the point of electrical contact of resilient member 60 and arm assemblies 34 and/or 36. For example, as shown in FIG. 3 protrusion 12*a* is located so that it can be displaced and not remain between a spring arm 60*a* of resilient member 60 and a stop tab 16*e* of arm assembly 36.

Base 12 also includes a plurality of apertures 8 formed therethrough for inserting electrical inputs and outputs therein. More specifically, each particular pin, a ground pin 13, an outside plant tip pin 24*a*, a central office tip pin 24*b*, an outside plant ring pin 26*a*, and a central office ring pin 26*b* are inserted into a corresponding aperture 8 of base 12. Tip pins 24*a* and 24*b* are attached and electrically connected to a tip arm 14 forming a tip arm assembly 34. Attaching pins 24*a* and 24*b* to tip arm 14 simplifies the manufacture and assembly of surge protector 10. Likewise, ring pins 26*a* and 26*b* are attached and electrically connected to a ring arm 16 forming a ring arm assembly 36. However, arm assemblies 34 and 36 could include only one component.

In one embodiment of the present invention, protrusions 12*a* of base 12 are integrally molded with base 12 and extend therefrom. However, as shown protrusions 12*a* may be removably attached to base 12. When protrusions 12*a* are integrally molded with base 12, the manufacture and assembly of surge protector 10 is simplified. On the other hand, removably attaching protrusions 12*a* to base 12 permits the use of two materials having different properties for base 12 and protrusions 12*a*. Additionally, protrusions 12*a* may be integrally molded with or removably attached to other suitable components and/or portions of surge protector 10. For example, protrusions 12*a* may be molded into cover 70. Molding protrusions 12*a* with cover 70 advantageously allows replacement of damaged protrusions 12*a* by simply removing and replacing cover 70.

Suitable materials for protrusions 12*a* will have melt and heat deflection temperatures in the range corresponding to thermal conditions at the sustained overvoltage condition of surge protector 10. Suitable materials for protrusions 12*a* include thermoplastics, thermosets, metals such as solder posts, or other suitable materials having desirable characteristics. Suitable materials should be free of embrittlement due to heat aging, be non-flammable under the overvoltage conditions, have acceptable mechanical properties and be inert to corrosives and weather. For example, base 12 and protrusions 12*a* can be formed from a polybutylene terephthalate such as Valox® available from General Electric Plastics of Pittsfield, Mass. Other suitable materials may include polycarbonates such as Lexan®, or blends of polyphenylene ether and styrene butadiene, such as Noryl®, both materials being available from General Electric Plastics; however, other suitable thermoplastics may be used.

In one embodiment, base 12 is formed from Valox® DR48 and has protrusions 12*a* integrally molded therewith. Protrusions 12*a* have a width w (FIG. 4) of about 0.05 inches; however, other suitable widths and/or materials may be used. Valox® DR48 has a melt temperature of about 250° C. and a heat deflection temperature of about 180° C. A heat deflection temperature is the temperature at which the material of 12*a* softens allowing resilient member 60 to displace protrusion 12*a*; however, the heat deflection temperature may also be a function of the restoring force of resilient member 60. Other materials having different melt and/or heat deflection temperatures may be used; however, a minimum heat deflection temperature, for example, about 100° C. may be desired to reduce the distortion of base 12 during, for example, high current testing of surge protector 10.

As best shown in FIGS. 1 and 2, tip arm assembly 34 and ring arm assembly 36 are similar, but arm assemblies 34 and 36 may have different configurations and/or different components. Arm assemblies 34 and 36 include an electrically conductive arm, more specifically a tip arm 14 and a ring arm 16, respectively. The details of tip arm 14 will be explained with the understanding that in the embodiment depicted ring arm 16 is similar. Tip arm 14 includes a first end portion 14*a*, a medial portion 14*b*, and a second end portion 14*c*. Tip pins 24*a* and 24*b* are electrically connected to tip contact 14 at medial portion 14*b*. Likewise, ring arm 16 includes a first end portion 16*a*, a medial portion 16*b*, and a second end portion 16*c*. Ring pins 26*a* and 26*b* are electrically connected to tip arm 16 at medial portion 16*b*. Tip arm 14 is generally shaped to provide resiliency between first end 14*a* and second end 14*c* for securely positioning gas tube 40, a portion of a ground plate 52, and varistor 48 therebetween when assembled.

Gas tube 40 is a 2-element gas tube, for example, a N80-C400X gas tube available from Epcos, Inc. of Chicago, Ill. Gas tube 40 includes a pair of lead electrodes 40*a* disposed on distal ends of gas tube 40. However, other suitable gas tubes may be used. Moreover, other configurations of surge protector 10 may employ a three-element gas tube, rather than the pair of two-element gas tubes. For example, a T-60-C350XS three-element gas tube available from Epcos, Inc.

When assembled as shown in FIG. 2, first end 14*a* of tip arm 14 is electrically connected to one of the pair of lead electrodes 40*a* of gas tube 40. The other lead electrode 40*a* of the same gas tube 40 is electrically connected to ground plate 52. Varistor 48 (not visible in FIG. 2) is disposed and electrically connected between second end 14*c* of tip arm 14 and ground plate 52. First end 14*a* of tip arm 14 may include a surface that generally complements the profile of a lead electrode 40*a* of gas tube 40 for securing gas tube 40 in position, or the surface may be generally planar. Likewise, second end 14*c* of tip arm 14 may include a surface having a profile for securing varistor 48 in position, or the surface may be generally planar.

Figure 6:
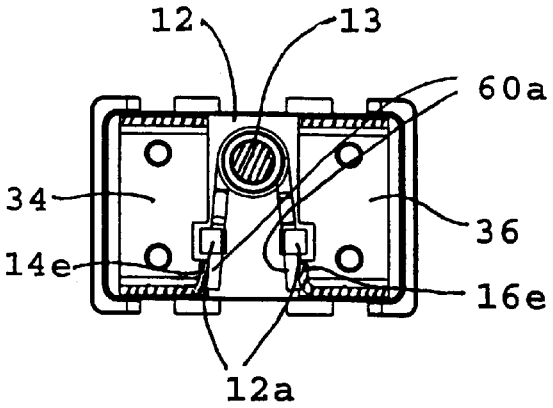
FIG. 6 is a sectional view of the surge protector of FIG. 1 with the cover removed taken through a transverse plane depicting the failsafe mechanism in a short circuit condition.

Ring arm 16 is shown in FIGS. 7 and 7*a* to clearly illustrate relevant portions thereof. Ring arm 16 includes a dimple 16*d*, stop tab 16*e*, and a cutout 16*f*. Although not shown, tip arm 14 likewise includes a dimple, a stop tab, and a cutout. Dimple 16*d* is disposed between medial portion 16*b* and second end portion 16*c* of ring arm 16 for inhibiting gas tube 40 from being inserted past its desired position (FIG. 3). Stop tab 16*e* is disposed generally on medial portion 16*b* of ring arm 16 and is aligned to provide a stop surface and electrical contact point for one of the spring arms 60*a* of resilient member 60 if protrusion 12*a* is displaced (FIG. 6). Cutout 16*f* keys ring arm assembly 36 so that pins 26*a* and 26*b* of ring arm assembly 36 can only be inserted into the correct apertures 8 of base 12. Moreover, cutout 16*f* allows for a more compact packaging of the components of surge protector 10.

As shown, cutout 16*f* is positioned behind, and out of the way of, stop tab 16*e*. This allows protrusions 12*a* to be spaced away from stop tab 16*e* when assembled. Thus, in operation if protrusions 12*a* soften and/or melt they will not remain in a path between the resilient member 60 and arm assemblies 34 and/or 36, thereby allowing resilient member 60 to make clean electrical contact therewith shorting a sustained overvoltage to ground element 50.

Ground element 50 includes ground plate 52 and ground pin 13. Ground plate 52 includes a first end portion 52*a* and a second end portion 52*b*. First end portion 52*a* of ground plate 52 is electrically connected to ground pin 13. More specifically, ground pin 13 includes a first end 13*a*, a collar 13*b* of a predetermined size, and a second end 13*c*. Collar 13*b* of ground pin 13 is disposed between first end 13*a* and second end 13*c* of ground pin 13, but is generally closer to second end 13*c*. Second end 13*c* of ground pin 13 is electrically attached to first end portion 52*a* of ground plate 52. Second end portion 52*b* of ground plate 52 may include a surface that complements the profile of lead electrode 40*a* of gas tube 40 for securing gas tube 40 in position, or it may be planar.

Resilient member 60 is electrically connected to ground element 50 and is in thermal contact therewith. In order to be operable, ground element 50 must effectively transfer heat to resilient member 60 to soften and/or melt protrusions 12*a* as a result of a sustained overvoltage. The heat transfer rate from ground element 50 to resilient member 60 may be influenced by, among other things, the contact surface area between the two components. Likewise, in order to be operable resilient member 60 requires a predetermined contact pressure to displace protrusions 12*a* and make suitable electrical contact with arm assemblies 34 and/or 36.

In one embodiment, resilient member 60 is a torsional spring having a pair of spring arms 60*a* with a coil 60*b* therebetween. However, resilient member 60 may be, for example, a helical spring, a leaf spring, or other suitable resilient member. When assembled, a first end 13*a* of ground pin 13 passes through an aperture (not shown) of coil 60*b* before first end 13*a* of ground pin 13 is received in the corresponding aperture 8 formed through base 12. Coil 60*b* is disposed between collar 13*b* of ground pin 13 and a surface 12*c* (FIG. 4) of base 12. Collar 13*b* is larger than the aperture of coil 60*b* to maintain resilient member 60 in a predetermined position between collar 13*b* and surface 12*c* of base 12. Additionally, collar 13*b* of ground pin 13 thermally contacts resilient member 60 facilitating heat transfer therebetween. Protrusions 12*a* of base 12 generally have an elevation above surface 12*c* about equal to, or higher, than collar 13*b*. However, in alternative embodiments other suitable configurations may be employed. For example, collar 13*b* of ground pin 13 may be eliminated so that resilient member 60 is disposed between ground plate 50 and surface 12*c* of base 12 as long as suitable heat transfer requirements are satisfied between ground plate 50 and resilient member 60.

As shown in FIG. 5, spring arms 60*a* of resilient member 60 are held in a compressed position by protrusions 12*a* of base 12 and are in thermal contact therewith. In this position, protrusions 12*a* prevent spring arms 60*a* from electrically contacting tip arm assembly 34 and ring arm assembly 36, thereby creating an open circuit between assemblies 34 and 36 and ground element 50. Moreover, protrusions 12*a* are positioned in such a manner so as to not interfere with the portions of spring arms 60*a* that are operable to short arm assemblies 34 and/or 36 to ground element 50. However, as shown in FIG. 6, when spring arms 60*a* are not biased by protrusions 12*a* they should be able to physically touch and electrically contact tip arm assembly 34 and ring arm assembly 36, thereby causing arm assemblies 34 and/or 36 to short to ground element 50 through resilient member 60. In one embodiment, resilient member 60 has a contact pressure of about 140 ksi against protrusions 12*a* during the open circuit condition, and a contact pressure of about 86 ksi against arm assemblies 34 and/or 36 during a short circuit condition. However, other suitable contact pressures may be used during open and short circuit conditions.

Cover 70 attaches to base 12 protecting internal components of surge protector 10 from adverse environmental effects and to provide personnel safety. Cover 70 is formed from a dielectric material, for example, a thermoplastic material. Cover 70 can be attached to base 12 by any suitable means, for example, tabs 12*b* on base 12 that correspond to apertures 70*b* on cover 70 may be used to secure cover 70.

During normal operation electrical current flow is from outside plant tip pin 24*a*, through electrically conductive tip arm 14, and to central office tip pin 24*b*. Likewise, during normal operation electrical current flow is from outside plant ring pin 26*a*, through electrically conductive ring arm 16, and to central office ring pin 26*b*.

If a sustained overvoltage event occurs, for example, where a high voltage line permanently contacts a line, gas tube 40 shorts the associated overcurrent to ground element 50, thereby increasing the temperature of ground element 50. Consequently, ground element 50 transfers heat to resilient member 60 increasing the temperature of resilient member 60. When resilient member 60 reaches a predetermined temperature range, spring arms 60*a* of resilient member 60 soften and/or melt the material of protrusions 12*a*. Consequently, spring arms 60*a* of resilient member 60 displace protrusion(s) 12*a* electrically contacting tip arm 14 of tip arm assembly 34 and/or ring arm 16 of ring arm assembly 36 shorting arm assemblies 34 and/or 36 to ground element 50 through resilient member 60. Thus, sustained overvoltages are permanently shorted to ground preventing damage to equipment and/or other injury to personnel.

Additionally, the present invention may combine the surge protection characteristics of gas tube 40 and varistors 48 achieving a surge protector wherein varistors 48 interact with gas tube 40 within a range of DC breakdown voltages to divert surges to the ground element. For example, varistor 48 may be a metal oxide varistor (MOV) having predetermined protection characteristics. With gas tube 40 and varistors 48 interacting, better surge response is achieved. However, depending on its configuration with respect to gas tube 40, varistors 48 may act merely as a back up device instead of interacting with gas tube 40.

Gas tube 40 by its nature is difficult to repeatedly manufacture with a precise DC breakdown voltage. Consequently, for a given population of gas tubes 40, the DC breakdown voltage varies across a range that is wider than the ranges of the other components. Accordingly, for a particular gas tube and manufacturing type, an acceptable DC breakdown voltage range is determined by selecting a minimum and a maximum DC breakdown voltage. Each gas tube is tested, and only those gas tubes that fall within predetermined minimum and maximum breakdown voltages are passed, thereby creating a population of gas tubes that fall within a preselected range of DC breakdown voltages. If the DC breakdown voltage range is too small, then too large of a percentage of gas tubes that are manufactured are not used, and thus wasted. If the DC breakdown voltage range is too large, then the ability to properly combine varistors with any gas tube in the range becomes more difficult.

The DC breakdown voltage is the voltage at which a gas tube breaks down and diverts electricity to the ground element when the rate of rise of the voltage is sufficiently low such that the ionization time of the gas tube is not exceeded. When the rate of rise of voltage reaches surge levels, the gas tube breaks down at an impulse breakdown voltage that is higher than the DC breakdown voltage. The impulse breakdown voltage is higher than the DC breakdown voltage because the ionization time of the gas tube allowed the voltage to rise above the DC breakdown voltage level before the gas tube could divert the surge. The impulse breakdown voltage of the gas tube varies as a function of the rate of rise of the voltage and the time it takes for a particular gas tube to direct the voltage surge to the ground element is commonly termed its "operate time".

On the other hand, varistors clamp voltages and thereby prevent voltages from getting too high. Varistors are immediate and are not rate of rise dependent like the gas tube. Instead, the clamping voltage of a varistor is a function of current. As current increases, the clamping voltage of the varistor increases.

In one embodiment, a varistor is combined with a gas tube so that the varistor acts as a replacement for an air gap back-up, and the clamping voltage of the varistor is sufficiently higher than the DC breakdown voltage of the gas tube. Consequently, the impulse breakdown voltage of the gas tube is not appreciably affected. However, in another embodiment the clamping voltage of the varistor relative to the DC breakdown voltage of the gas tube is predetermined so that the varistor will clamp voltage surges during the ionization time of the gas tube, thereby lowering the impulse breakdown voltage of the gas tube. FIG. 8 illustrates an exemplary voltage response of the present invention whereby the interacting varistor acts to lower the impulse breakdown voltage by clamping the voltage surge until the gas tube responds.

However, even gas tubes made on the same manufacturing line have a wide range of DC breakdown voltages. The present invention takes into account the range of DC breakdown voltages of gas tubes by setting the varistor clamping voltage at a point to achieve optimal coordination between the varistor and any gas tube in the range of DC breakdown voltages as described below. Doing so balances two competing objectives, namely: 1) lowering the impulse breakdown voltage below that of a gas tube alone for any gas tube in the population; yet 2) allowing the gas tube to protect the varistor from being burned out for any gas tube in the population.

If the clamping voltage of the varistor is set too high, there may be some gas tubes at the low end of the range where the impulse breakdown voltage will not be lowered and the varistor operates merely as a back-up device. If the clamping voltage of the varistor is set too low, the varistor could be burned out before the gas tube can divert the surge to the ground element when the varistor is matched with a gas tube at the high end of the range of DC breakdown voltages.

In one embodiment, the difference between the minimum and the maximum DC breakdown voltage of gas tube 40 is between about 115 volts and about 155 volts, and more preferably is about 135 volts. Preferably the minimum DC breakdown voltage is about 265 volts and the maximum DC breakdown voltage is about 400 volts. The operate time of gas tube 40 is preferably between about 1 to about 20 microseconds.

In one embodiment, the clamping voltage of the varistor at 1 mA is set in the middle 60% of the range of the DC breakdown voltages, and more preferably, is set at about the middle of the range of the DC breakdown voltages. In the preferred range of DC breakdown voltages of 265 to 400 volts, the clamping voltage of the varistor is preferably between about 300 volts and about 400 volts or more. In these preferred ranges, the varistor can be selected to have a clamping voltage that will lower the impulse breakdown voltage of a gas tube with a DC breakdown voltage at 265 volts, and yet will not burn out when matched with a gas tube with a DC breakdown voltage of 400 volts. By way of example, a T67 gas tube may be used with two 5 mm metal oxide varistors both available from Epcos, Inc. of Chicago, Ill.

In other embodiments of the present invention, protrusions 12*a* may be integrally molded or attached to other suitable components of surge protector 10, rather than base 12. For example, as shown in FIGS. 10*a* and 10*b*, a pair of protrusions 12*a*' are integrally molded with a cover 70' suitable for use with a surge protector 10'. Surge protector 10' is similar to surge protector 10 in both concept and operation and the general differences between the two embodiments will be described herein.

As shown in FIG. 11, surge protector 10' includes a base 12' for inserting a tip arm assembly (not shown), a ring arm assembly 36', and a ground element 50' therein. Ground element 50' includes a ground pin 13' and ground plate 52'. Ground plate 52' is generally longer than ground plate 52 of surge protector 10 because a first end 52' of ground plate 52' generally extends to base 12'. Additionally, ground pin 13' is generally shorter than ground pin 13 of surge protector 10 because ground pin 13' does not require collar 13*b*.

Instead, as shown in FIG. 9, a resilient member assembly 65' is electrically attached to ground element 50. Resilient member assembly 65' includes a stud 62' and resilient member 60'. Resilient member 60' is thermally and electrically connected at coil 60*b*' to a stud 62', which is thermally and electrically connected to a second end portion 52*b*' of ground plate 52'. When surge protector 10' is assembled with the cover removed, respective spring arms 60*a*' of resilient member 60' contact a portion of tip arm assembly and a portion of ring arm assembly 36'. More specifically, the respective spring arm 60*a*' of resilient member 60' electrically contacts ring arm assembly 36' at a stop tab (not shown) disposed on ring arm 16' that is generally aligned with spring arm 60*a*'. Likewise, the respective spring arm 60*a*' of resilient member 60' electrically contacts tip arm assembly at a stop tab on tip arm (not shown). However, when cover 70' is inserted over and attached to base 12', knife edges 72' of cover 70' slide between respective spring arms 60*a*' of resilient member 60'0 and a portion of tip arm assembly and ring arm assembly 36' allowing protrusions 12*a*' to be disposed therebetween. In other words, when cover 70' is attached to base 12', protrusions 12*a*' on cover 70' bias spring arms 60*a*' of resilient member 60' towards each other preventing electrical contact between the spring arms 60*a*' and a portion of the respective tip arm and/or ring arm assemblies. Thus, unless, and until, a sustained overvoltage condition occurs that will soften and/or melt protrusions 12*a*', the tip arm and/or ring arm assemblies remain in an open circuit condition with respect to ground element 50'.

Other suitable configurations of the present inventive concepts may also be practiced. For example, surge protector 10 and/or 10' may be configured as a 1-pin, a 4-pin, or other suitable configuration of a surge protector. In the 1-pin configuration, the single pin is electrically connected the ground element and the ring and tip arm assemblies are configured for inserting pins therein. In other embodiments, a 4-pin configuration includes two pins located on each of the tip arm and ring arm assemblies and a ground element suitably configured for inserting a pin therein.

Many modifications and other embodiments of the present invention, within the scope of the appended claims, will become apparent to a skilled artisan. For example, the pair of two-element gas tubes may be replaced with a single three-element gas tube. Additionally, electrical components may be plated for environmental protection. Therefore, it is to be understood that the invention is not to be limited to the specific embodiments disclosed and that modifications and other embodiments may be made within the scope of the appended claims. Although specific terms are employed herein, they are used in a generic and descriptive sense only and not for purposes of limitation. The invention has been described with reference to central office protectors but the inventive concepts of the present invention are applicable to other surge protectors and other suitable devices having failsafe mechanisms.

That which is claimed:

1. A surge protector having a failsafe mechanism comprising:

at least one overvoltage protection element;

at least one arm assembly;

at least one ground element;

at least one resilient member; wherein the at least one resilient member is electrically connected to the at least one ground element;

at least one protrusion operably positioned between the at least one resilient member and the at least one arm assembly; wherein the at least one protrusion is in thermal contact with the at least one resilient member, the at least one protrusion prevents the at least one resilient member from electrically contacting the at least one arm assembly during normal operation; and wherein as a result of a sustained overvoltage condition the temperature of the at least one resilient member increases to soften the at least one protrusion and allow the at least one resilient member to electrically contact the at least one arm assembly and thereby short the at least one arm assembly to the ground element.

2. The surge protector according to claim 1, further comprising a base the protrusion extending from the base.

3. The surge protector according to claim 1, further comprising a cover the protrusion extending from the cover.

4. The surge protector according to claim 1, further comprising a base the protrusion being removably attachable to the base.

5. The surge protector according to claim 1, the resilient member being a torsional spring.

6. The surge protector according to claim 1, the at least one arm assembly having at least one pin electrically connected at a medial portion of the arm assembly.

7. The surge protector according to claim 1, the overvoltage protection element comprising at least one gas tube and at least one varistor; the at least one gas tube having an impulse breakdown voltage and a DC breakdown voltage, the DC breakdown voltage being in a range between a predetermined minimum and maximum value, and the impulse breakdown voltage being higher than the predetermined maximum DC breakdown voltage; and the at least one varistor and the at least one gas tube being electrically connected in parallel to the ground element, the at least one varistor having a clamping voltage at 1 mA between the predetermined minimum and maximum DC breakdown voltages of the at least one gas tube, and wherein the varistor clamps the voltage during a voltage surge to reduce the impulse breakdown voltage of the gas tube without the varistor burning out.

8. The surge protector according to claim 7, the predetermined minimum value DC breakdown voltage being about 265 volts and the predetermined maximum value of DC breakdown voltage being about 400 volts.

9. The surge protector according to claim 7, the clamping voltage of the varistor being at least about 300 volts.

10. The surge protector according to claim 1, the protrusion being formed from a material selected from one of a thermoplastic, a thermoset, and a metal.

11. The surge protector according to claim 1, the at least one protrusion being spaced apart from the at least one arm assembly.

12. A surge protector having a failsafe mechanism comprising:

a base;

at least one overvoltage protection element;

at least one ground element;

at least one arm assembly;

at least one resilient member; wherein the at least one resilient member is electrically connected to the at least one ground element;

at least one protrusion extending from the base; wherein the at least one protrusion is in thermal contact with the at least one resilient member and prevents the at least one resilient member from electrically contacting the at least one arm assembly during normal operation; and wherein as a result of a sustained overvoltage condition the temperature of the at least one resilient member increases thereby softening the at least one protrusion and allowing the at least one resilient member to electrically contact the arm assembly to short the arm assembly to ground.

13. The surge protector according to claim 12, the resilient member being a torsional spring.

14. The surge protector according to claim 12, the protrusion being an integral portion of the base.

15. The surge protector according to claim 12, the protrusion being removably attachable to the base.

16. The surge protector according to claim 12, the at least one arm assembly having at least one pin electrically connected at a medial portion of the arm assembly.

17. The surge protector according to claim 12, the overvoltage protection element comprising at least one gas tube and at least one varistor; the at least one gas tube having an impulse breakdown voltage and a DC breakdown voltage, the DC breakdown voltage being in a range between a predetermined minimum and maximum value, and the impulse breakdown voltage being higher than the predetermined maximum DC breakdown voltage; and the at least one varistor and the at least one gas tube being electrically connected in parallel to the ground element, the at least one varistor having a clamping voltage at 1 mA between the predetermined minimum and maximum DC breakdown voltages of the at least one gas tube, wherein the varistor clamps the voltage during a voltage surge to reduce the impulse breakdown voltage of the gas tube without the varistor burning out.

18. The surge protector according to claim 17, the predetermined minimum value DC breakdown voltage being about 265 volts and the predetermined maximum value of DC breakdown voltage being about 400 volts.

19. The surge protector according to claim 17, the clamping voltage of the varistor being at least about 300 volts.

20. The surge protector according to claim 12, the at least one protrusion being spaced apart from the at least one arm assembly.

21. The surge protector according to claim 12, the protrusion being formed from a material selected from one of a thermoplastic, a thermoset, and a metal.

22. A surge protector having a failsafe mechanism comprising:

a base, the base having a generally planar surface;

at least one overvoltage protection element;

a ground element, the ground element comprising a ground pin, the ground pin having a collar;

at least one arm assembly;

a torsional spring, the torsional spring having at least one arm and a coil with an aperture therethrough; wherein the torsional spring is in electrical contact with the ground pin, and the coil of the torsional spring is disposed between the collar of the ground pin and the planar surface of the base;

at least one protrusion extending from the planar surface of the base; wherein the at least one protrusion is in thermal contact with the at least one torsional spring and prevents the at least one torsional spring from electrically contacting the at least one arm assembly during normal operation; and wherein as a result of a sustained overvoltage condition the temperature of the at least one arm of the torsional spring increases thereby softening the at least one protrusion and allowing the at least one arm of the torsional spring to electrically contact the arm assembly to short the arm assembly to the ground pin.

23. The surge protector according to claim 22, the protrusion being removably attachable to the base.

24. The surge protector according to claim 22, the overvoltage protection element comprising at least one gas tube and at least one varistor; the at least one gas tube having an impulse breakdown voltage and a DC breakdown voltage, the DC breakdown voltage being in a range between a predetermined minimum and maximum value, and the impulse breakdown voltage being higher than the predetermined maximum DC breakdown voltage; and the at least one varistor and the at least one gas tube being electrically connected in parallel to the ground element, the at least one varistor has a clamping voltage at 1 mA between the predetermined minimum and maximum DC breakdown voltages of the at least one gas tube, wherein the varistor clamps the voltage during a voltage surge to reduce the impulse breakdown voltage of the gas tube without the varistor burning out.

25. The surge protector according to claim 24, the predetermined minimum value DC breakdown voltage being about 265 volts and the predetermined maximum value of DC breakdown voltage being about 400 volts.

26. The surge protector according to claim 24, the clamping voltage of the varistor being at least about 300 volts.

27. The surge protector according to claim 22, the at least one protrusion being spaced apart from the at least one arm assembly.

28. The surge protector according to claim 22, the protrusion being an integral portion of the base and being formed from a material selected from one of a thermoplastic, and a thermoset.

* * * * *